US006505025B2

(12) United States Patent
Miyamura

(10) Patent No.: US 6,505,025 B2
(45) Date of Patent: Jan. 7, 2003

(54) COLOR IMAGE FORMING APPARATUS AND PROCESS

(75) Inventor: Hiroaki Miyamura, Tokyo (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/887,845

(22) Filed: Jun. 22, 2001

(65) Prior Publication Data

US 2002/0018674 A1 Feb. 14, 2002

(30) Foreign Application Priority Data

Jun. 22, 2000 (JP) ..... 2000-188024
Jun. 29, 2000 (JP) ..... 2000-197261

(51) Int. Cl.[7] ..... G03G 15/01; G03G 15/00

(52) U.S. Cl. ..... 399/302; 399/66; 399/45; 399/82; 399/85

(58) Field of Search ..... 399/66, 45, 297, 399/298, 302, 308, 82, 85

(56) References Cited

FOREIGN PATENT DOCUMENTS

| | | | |
|---|---|---|---|
| JP | 61-223856 | | 10/1986 |
| JP | 07-43975 | * | 2/1995 |
| JP | 2000-047451 | | 2/2000 |
| JP | 2000-047452 | | 2/2000 |

* cited by examiner

*Primary Examiner*—Hoang Ngo
(74) *Attorney, Agent, or Firm*—Joel E. Lutzker; Anna Vishev; Schulte, Roth & Zabel LLP

(57) ABSTRACT

A color image forming apparatus for printing color images for a plurality of recording mediums having one or more photoreceptors for forming toner images of different color toners. The toner images are superimposed onto the intermediate transfer drum having a length of circumference such that a plurality of color images for the plurality of recording mediums can be held on this intermediate transfer drum. The superimposition of colors is done by consecutively repeating the primary transfer of each toner developed on the photoreceptor to the intermediate transfer drum. The toner images are formed on the photoreceptor and transferred to the intermediate transfer drum consecutively if the color images to be printed are solely of a specific monochrome color. If however, these color images are of a polychrome color or a monochrome color other that the specific monochrome color the toner images are formed and superimposed onto the intermediate transfer drum with a timing delay equal to a predetermined number of rotations of the intermediate transfer drum.

14 Claims, 10 Drawing Sheets

COLOR IMAGE FORMING APPARATUS AND PROCESS

BACKGROUND OF THE INVENTION

1. Field of the Invention

The present invention relates to a color image forming apparatus and process using an intermediate image transfer in an electrophotographic process, typically utilized by copying machines, printers, facsimiles, etc. Specifically, the present invention relates to a color image forming apparatus and process which enables the formation of color images for a plurality of recording mediums on the intermediate transfer drum.

2. Description of the Related Art

Japanese Patent Publication No. 2-28867 discloses a color image forming apparatus which has a photoreceptor drum for forming images for two recording mediums. In accordance with the disclosure of this publication, during the image formation process of the high speed printing, the second image is formed on the photoreceptor immediately succeeding the formation of the first image on the same photoreceptor. The length of the photoreceptor's circumference is sufficient for forming consecutive images for two recording mediums.

When the color image forming apparatus constructed according to Japanese Patent Publication No.2-28867 is used for replicating the same image, a relatively high forming speed is realized for forming this image on the photoreceptor. However, when different images have to be replicated, the throughput decreases, because formation of each succeeding image does not start until the image processing of its preceding image is finished.

To solve the above problem, the applicant of the present invention has proposed a color image forming apparatus shown in Japanese Unexamined Patent Publication No. 2000-47452. The apparatus disclosed in Japanese Unexamined Patent Publication No. 2000-47452 has an intermediate transfer drum having a circumference sufficient to form images for two recording mediums on the intermediate transfer drum, where the throughput is increased by suppressing the second image formation in response to the first image processing time.

However, the image forming apparatus according to Japanese Unexamined Patent Publication No. 2000-47452 has not taken into consideration the case of mixed monochromatic-and-color printing. When a mixed monochrome and color printing is performed on the apparatus constructed in accordance with this patent publication, for example, when the apparatus processes a preceding image containing full four colors following by a succeeding monochromatic image, a problem may occur where the image output of the succeeding monochromatic image may outrun the output of the preceding image causing out-of-order pages.

Another problem is that the throughput of the color image forming apparatus according to Japanese Patent Publication No. 2-28867 is higher than the throughput of the color image forming apparatus according to Japanese Unexamined Patent Publication No. 2000-47452 when the same images are replicated.

A further problem of the apparatus disclosed in Japanese Unexamined Patent Publication No. 2000-47452 is that, the adjustment of processing timing with timing of after-processing devices, for example, doublesided printing device, sorter, stacker, etc., is complicated when the first and second images are formed on the photoreceptor, and the timing of the second image formation is delayed during the image processing.

Still another problem with the apparatus of Publication No.: 2000-47452 is that the picture quality may be reduced because of the complicated control of development, transfer, fixing, cleaning, etc. accompanying the image formation, and because the load of the photoreceptor and intermediate transfer drum increasingly varies.

A yet further problem arises when a scanner is installed as an external unit and the apparatus is used as a copying machine. An output delay may then occur if the user tries to copy the images by repeatedly pushing the "print" button.

SUMMARY OF THE INVENTION

The present invention is made in light of the problems mentioned above. It is an object of the present invention to enable high quality color image processing at high throughput while replicating the same image or printing different images.

It is another object of the present invention to provide color image processing in which timing synchronization is easy to perform during the image processing even when an external option, for example a scanner, is installed.

It is a further object of the present invention to provide a color copying apparatus which does not cause output delays when a scanner is installed as an external unit and the apparatus is used as a copying machine.

It is still a further object of the present invention to provide a color image forming apparatus which can perform printing while preserving the right printing order of pages without reduction of throughput even in the case of mixed monochrome-and-full-color printing.

It is still a further object of the present invention to provide a high throughput color image forming apparatus which can perform printing of images for a plurality of recording mediums and where the images are formed on the intermediate transfer drum.

To accomplish the above enumerated objects, an image forming apparatus is provided in accordance with the present invention, which can form images for a plurality of recording mediums. A color image forming apparatus for printing color images for a plurality of recording mediums having one or more photoreceptors for forming toner images of different color toners. The toner images are superimposed onto the intermediate transfer drum having a length of circumference such that a plurality of color images for the plurality of recording mediums can be held on this intermediate transfer drum. The superimposition of colors is done by consecutively repeating the primary transfer of each toner developed on the photoreceptor to the intermediate transfer drum. The toner images are formed on the photoreceptor and transferred to the intermediate transfer drum consecutively if the color images to be printed are solely of a specific monochrome color. If however, color images of a polychrome color or a monochrome color other that the specific monochrome color are to be printed, the toner images are formed and superimposed onto the intermediate transfer drum with a timing delay equal to a predetermined number of rotations of the intermediate transfer drum.

With the provided configuration, a color image forming apparatus controls printing and eliminates the problem of the later page outrunning the preceding page even in the case of mixed monochrome and full-color printing. The provided apparatus can further perform an accurate printing at high throughput.

Further, the provided color image forming apparatus allows the superimposed color images for a plurality of recording mediums to be formed within the same image forming cycle on the intermediate transfer drum.

The mentioned specific monochrome may be selected to be any of the monochromes provided in the apparatus, for example black or magenta.

The provided color image forming apparatus has plural image formation control means for determining whether the formation of the images is possible on the intermediate transfer drum. A first of two consecutive color images for a plurality of recording mediums is formed on the intermediate transfer drum if the plural image formation control means determine that this formation is possible. A succeeding superimposed color image may be formed on the intermediate transfer drum after the first superimposed color image if the plural image formation control means determine that the formation of these superimposed color images is not possible.

A method of forming color images is also provided in accordance with the present invention. The color images are formed in the provided color image forming apparatus. The apparatus preferably allows its user to select a consecutive formation of images for a plurality of recording mediums on the intermediate transfer drum or alternatively to select a delayed formation of these images on the intermediate transfer drum. When the delayed formation is selected, there is a time delay between formation of two consecutive images. Switching between different types of image formation is preferably done according to the operational mode of the provided apparatus. The time delay between the formation of the two consecutive images may be set beforehand and preferably is equal to a predetermined number of rotations of the intermediate transfer drum. Images for three or more recording mediums may be held on the provided intermediate transfer drum.

Further features and advantages of the invention will become evident to one skilled in the art upon reading of the detailed description of the invention, which is given below by way of example only and with reference to the accompanying drawings.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE PREFERRED EMBODIMENTS AND THE DRAWINGS

A preferred embodiment of the present invention is detailed with reference to the accompanying drawings.

Figure 1:
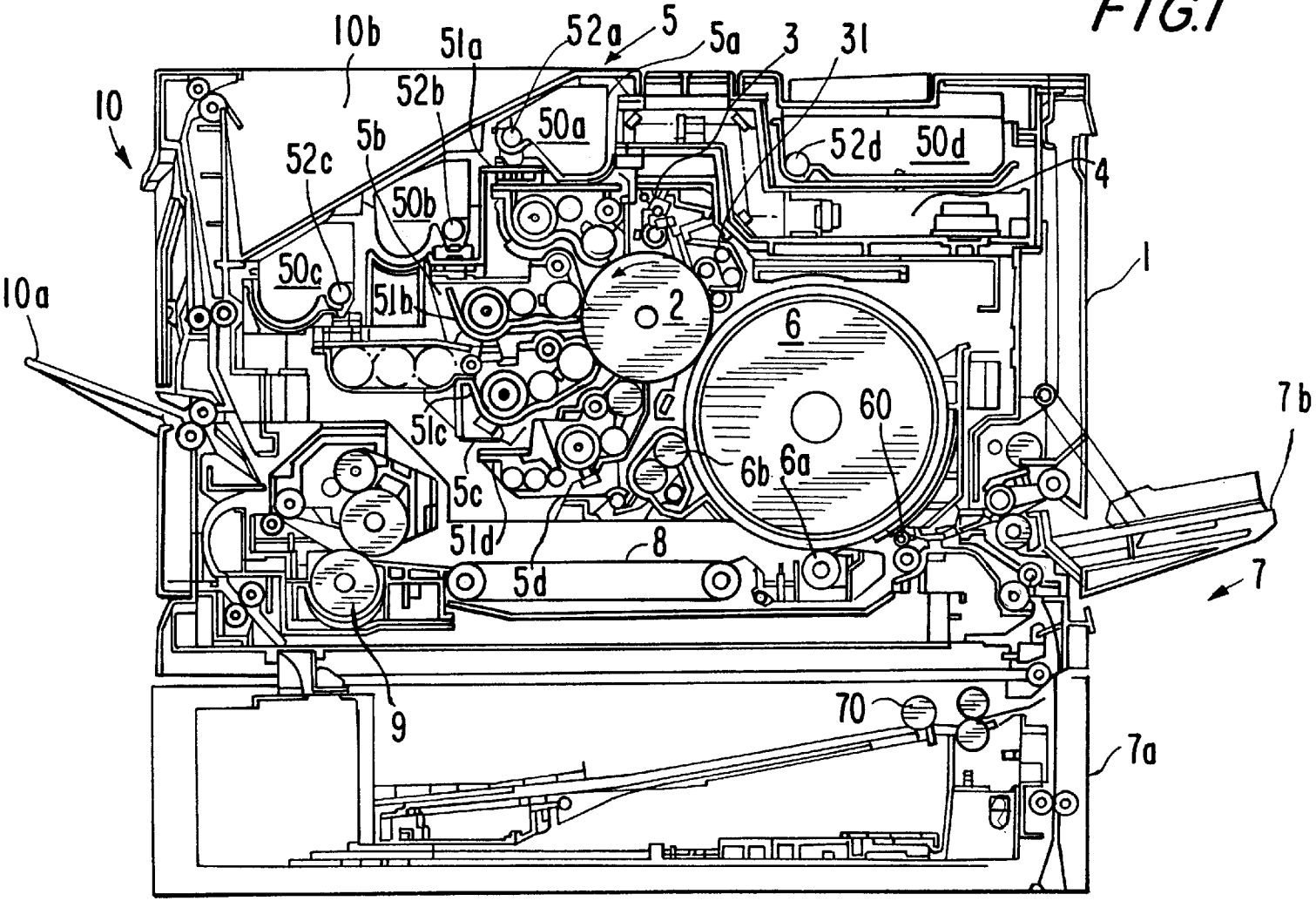
FIG. 1 is a longitudinal cross-sectional view of a color image forming apparatus according to the present invention.

FIG. 1 shows a longitudinal cross-section of a color image forming apparatus provided in accordance with the preferred embodiment of the present invention. Reference number 1 refers to the main unit of the color image forming apparatus. A photoreceptor drum 2, preferably made of photosensitive material such as OPC or a-Si, is located within the main unit 1. A predetermined bias voltage is applied to the face of the photoreceptor drum 2 from an electric power source (not shown) by the drum of a charging roller 3. An exposure device 4 irradiates image information by laser light from an outside terminal and conveys this image information to the charged outer surface of the photoreceptor 2 to form latent images thereon. In the preferred embodiment of the present invention a light emitting diode (LED) may be used to accomplish the described exposing process.

Reference number 5 corresponds to developing devices for developing color toners on the latent images formed on the photoreceptor. In the embodiment shown in FIG. 1, a developing device 5*a* is preferably used for developing yellow toner, a developing device 5*b* is preferably used for developing magenta toner, a developing device 5*c* is preferably used for developing cyan toner, and a developing device 5*d* is preferably used for developing black toner. The developing devices 5*a*–5*d* are arranged in sequence starting from the upstream side of the photoreceptor 2 and following the direction of rotation. As shown in FIG. 1, each developing device preferably comprises a toner container, a developer, and a toner supply roller. Toner containers for the developing devices 5*a*–5*c* are preferably located in the upper part of the provided color image forming apparatus. In the preferred embodiment, the developing device 5*a* comprises a toner container 50*a* containing yellow toner, and a developer 51*a* for developing the toner supplied by a supply roller 52*a;* the developing device 5*b* comprises a toner container 50*b* containing magenta toner and a developer 51*b* for developing the toner supplied by a supply roller 52*b;* the developing device 5*c* comprises a toner container 50*c* containing cyan toner and a developer 51*c* for developing the toner supplied by a supply roller 52*c;* and the developing device 5*d* comprises a toner container 50*d* containing black toner and a developer 51*d* for developing the toner supplied by a supply roller 52*d*. In the present invention, nonmagnetic toners are used. Reference number 31 corresponds to a cleaning roller for removing the toner not transferred onto the intermediate transfer drum 6 from the photoreceptor drum 2.

The superimposition of colors is done by consecutively repeating the primary transfer of each toner developed on the photoreceptor drum 2 to the intermediate transfer drum 6 by applying the predetermined bias. Reference number 6*a* corresponds to a secondary transfer drum, and reference number 6*b* refers to a cleaning roller. A shunting mechanism (not shown) is preferably provided in this embodiment for shunting aside the secondary transfer drum 6*a* and cleaning roller 6*b* from the intermediate transfer drum 6, during the superimposition of colors, until each color is completely superimposed.

A paper-feed mechanism 7 comprises a paper-feed unit 7*a* located in the lower side of the color image forming apparatus 1 and loaded with a large volume of sheets of paper. The uppermost paper sheet in the paper-feed unit 7*a* is transferred by a paper-feed roller 70, and a hand-supplying unit which transfers sheets one by one. The paper sheet sent for printing from the paper-feed means 7 is transferred to a pair of register rollers 60 to be aligned as to the tip and adjusted as to the timing. The sheet is then transferred between the intermediate transfer drum 6 and the secondary transfer drum 6*a,* where the superimposed color image is transferred from the intermediate drum onto the sheet. The sheet is then conveyed on a transfer belt 8 toward an outlet. Toners transferred onto the sheet are fused into place by heat and pressure applied by the fusing device 9 provided near the outlet.

A face-up tray 10*a,* on which the sheet with the fused image is ejected with the fused image side up, and a face-down tray 10*b,* on which the sheet with the fused image is ejected with the fused image side down, are mounted to a paper output mechanism 10.

Figure 2:
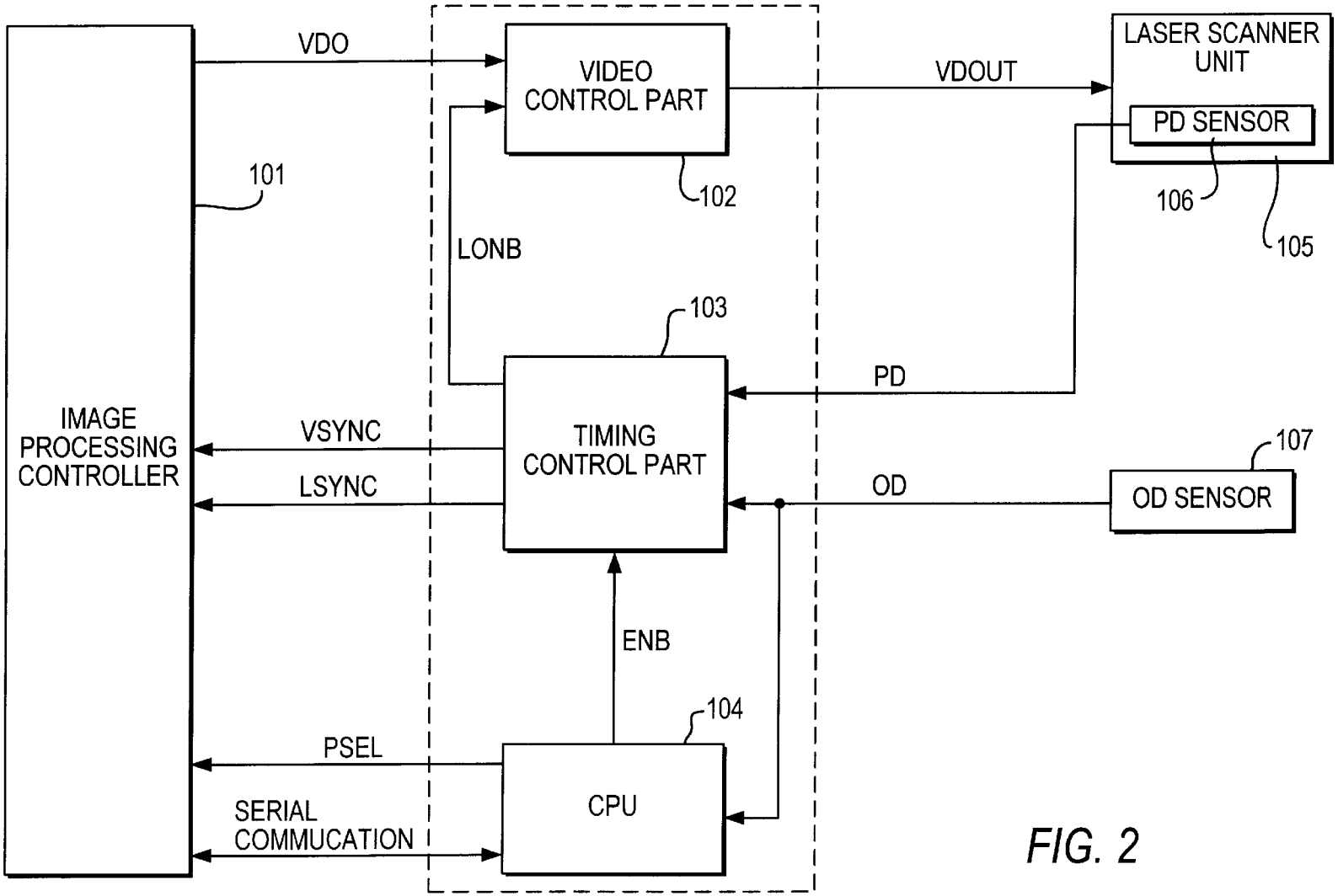
FIG. 2 is a schematic block diagram showing the flow of control signals in the apparatus configured in accordance with the present invention.

FIG. 2 is a block diagram showing the flow of signals accomplishing operational control of the provided color image forming apparatus. A detailed outline of this operational control is explained hereunder.

When an image is supplied to the apparatus for printing, the image processing controller 101 gathers the content of the image and conveys a print request to the engine control central processing unit (CPU) 104 through the serial communication line. Since the image processing controller 101 has already grasped the contents of the image to be printed, the mode of image formation is also conveyed through the serial communication line with about the same timing.

When the print request is received by the engine control CPU 104, it switches on the provided motors, for example, a scanner motor, a main motor, etc., to prepare them for printing. When the scanner motor of the laser scanner unit 105 rotates, the PD sensor 106 detects and outputs the scanning direction signal. When the main motor rotates, the OD sensor 107 detects and outputs the timing signal of the sub-scanning direction. The detected scanning direction (PD) and the detected sub-scanning direction (OD) are both input into the timing control part 103. The engine control CPU 104 monitors the timing control section 103, and, when the CPU recognizes that the motors such as the scanner motor and the main motor have reached the rated rotation speed, it permits the timing control section to start its functions.

When the operation of the timing control section 103 is permitted by the engine control CPU 104, the timing control section outputs the image writing (printing) timing signal VSYNC corresponding to the OD signal, and the scanning direction timing signal LSYNC corresponding to the PD signal. The engine control CPU 104 also outputs the signal LONB for controlling the laser power of the laser scanner unit 105 irrespective of the described above permission to operate issued by the engine control CPU 104. The engine control CPU 104 also monitors the OD signal directly and switches the page selection signal PSEL according to the provided page selection flags.

The image processing controller 101 selects the primary image data (data for the first sheet formed on the intermediate transfer drum) or the secondary data (data for the second sheet formed on the intermediate transfer drum) to output this selected data to the video control section 102 according to the image writing timing signal VSYNC, scanning direction timing signal LSYNC, and page selection signal PSEL. The selected data is output from the image processing controller 101 by the video signal VDO. The video control section 102 merges the video signal VDO from the image processing controller 101 and the signal LONB for controlling the laser power of the laser scanner unit 105 to output the composite signal to the laser scanner unit 105.

When the engine control CPU 104 does not permit the timing control section 103 to go into action, the image writing timing signal VSYNC and scanning direction timing signal LSYNC are not output from the timing control section 103.

Figure 3:
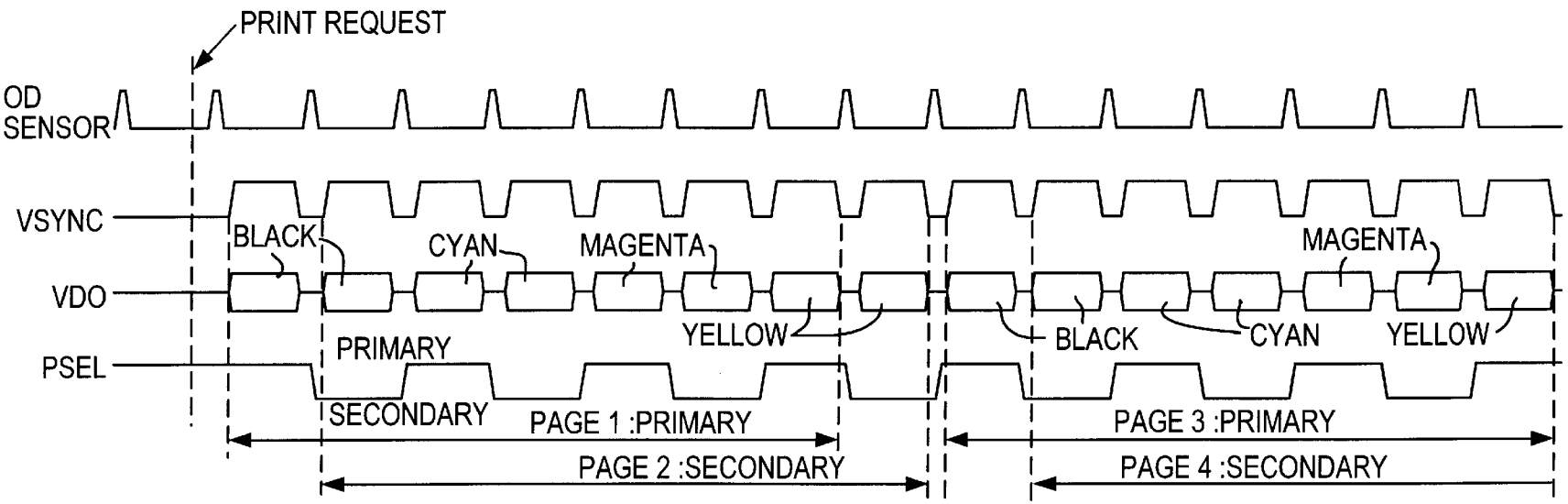
FIG. 3 is a diagram showing the timing and operational sequence of the apparatus when it is operated in the copy mode in accordance with the preferred embodiment of the present invention.

FIG. 3 is a diagram detailing the timing and operation of the provided apparatus when it is operated in the copy mode (i.e., multiple copying of the same image) according to the first preferred embodiment of the present invention. The outline of operation is explained hereunder.

When a print request is made from the image processing controller 101 through the serial communication line, that is, when a copy mode is set on the primary selection mode of image formation, a print command of a plurality of sheets is conveyed through the serial communication line at about the same time as the print request. In the preferred embodiment of copy mode operation, both the primary and secondary image formations are done consecutively by the same developing devices and transferred onto the intermediate transfer drum. For example, as shown in FIG. 3, first the black toner image is formed and transferred to the primary side of the intermediate drum, then the same black toner image is formed again and transferred to the secondary side of the intermediate drum; in the next step, the cyan toner image is formed and superimposed over the black toner image on the primary side of the intermediate transfer drum, and then the same cyan image is formed again and superimposed over the black toner image on the secondary side of the intermediate transfer drum, and so on until all four color toners are superimposed on the intermediate transfer drum. The same timing and operational sequences may be applied when the image processing controller is set for the external image scanner unit. Further, when printing of different images in a copy mode is requested, the same operational sequences may be utilized. Although the invention is described with respect to the embodiment where images for two recording mediums are formed on the intermediate transfer drum and the image formation timing signal OD is output two times per one rotation of the intermediate transfer drum, it is possible to configure the provided apparatus so that the image formation signal OD is output more than two times per one rotation of the intermediate transfer drum and images for more than two recording mediums maybe formed on the intermediate transfer drum. Signals to be used in this alternative embodiment are selected from among the plurality of available signals as needed.

Figure 4:
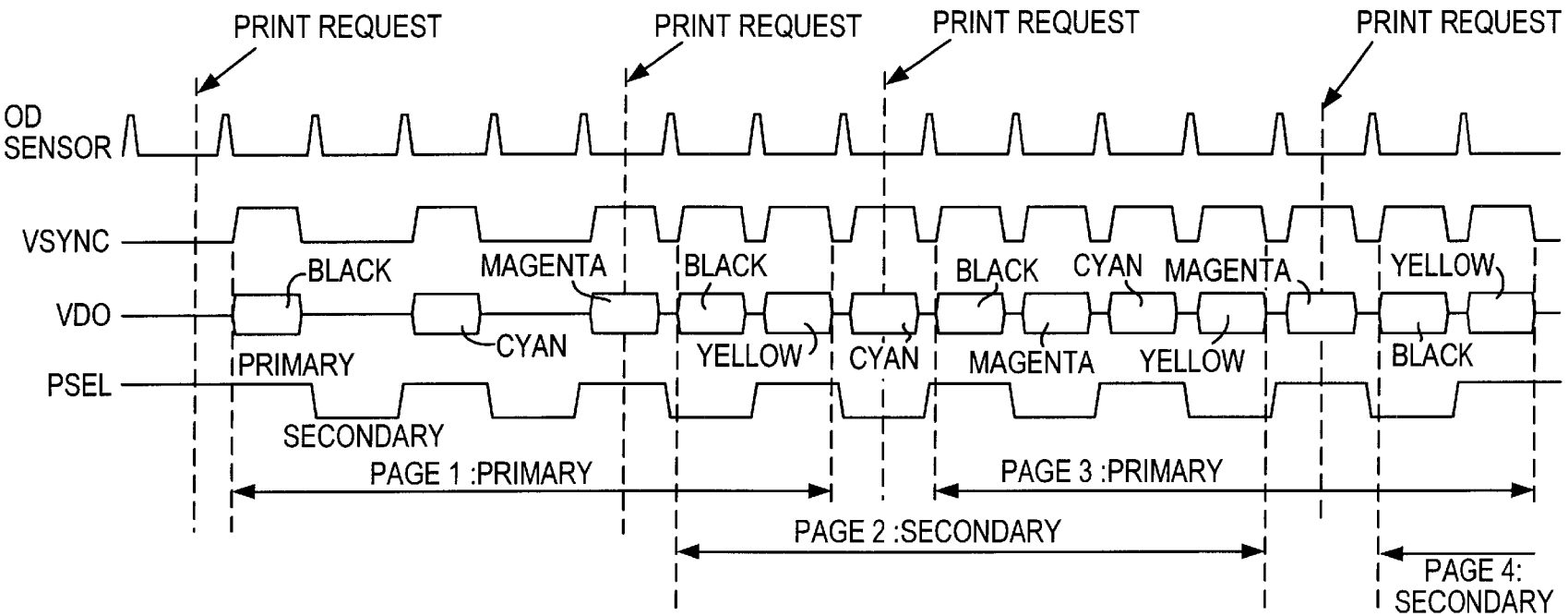
FIG. 4 is a diagram showing the timing and operational sequence of the apparatus when it is operated in the delay mode in accordance with the preferred embodiment of the present invention.

FIG. 4 is a diagram detailing the timing and operation of the provided apparatus when it is operated in the delay mode when the image formation is done with the second means selected. The outline of operation is explained hereunder.

Similarly to the described above copy mode embodiment, a printing request is made from the image processing controller 101 through the serial communication line. Regardless of whether different images or a single image is requested, the signal indicating the delay mode is conveyed in about the same time as the print request through the serial communication line. When both signals are received, the formation of primary image is started. The next print request may then be made by the image processing controller. If this subsequent print request comes by the time when the formation of a secondary image with an applied delay is determined to be possible, the secondary image is formed on the secondary side of the intermediate transfer drum. Generally, if the operational mode of the apparatus is any mode other than a copy mode, delay mode is set as default. Although in FIG. 4 the timing of image formation on the secondary side is formed with the delay of two rotations of the intermediate transfer drum, the number of delay rotations of the intermediate transfer drum for delaying the image formation thereon can be changed arbitrarily, and can be set in accordance with a treating ability of the image processing controller 101 and a complexity of the image to be processed through the serial communication line.

Figure 5:
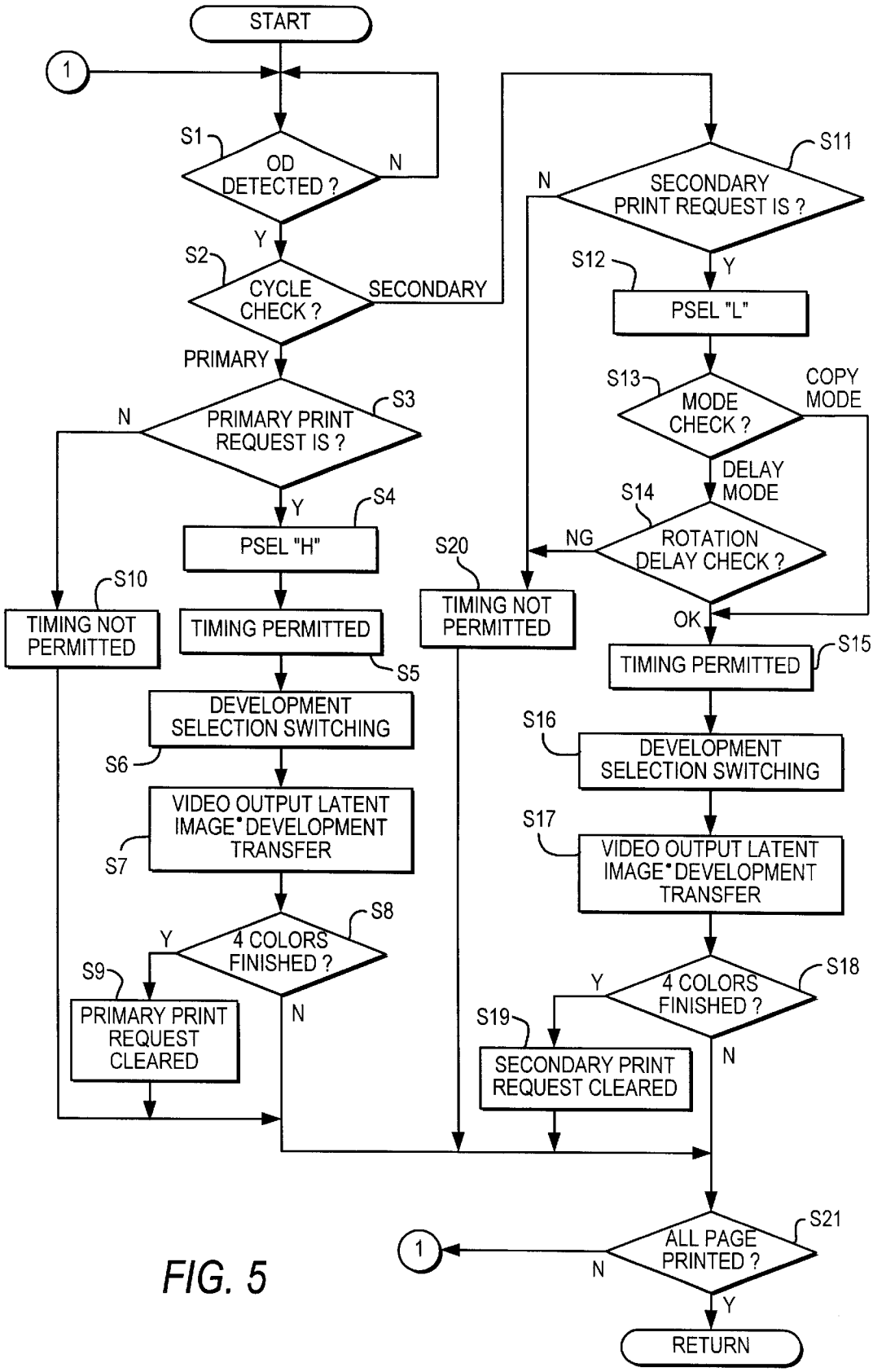
FIG. 5 is a flowchart showing the logical flow of information during the printing sequence of the apparatus in accordance with the preferred embodiment of the present invention.

FIG. 5 is a flowchart showing the logical flow of information during the printing sequence of the provided apparatus. The outline of operation is explained hereunder.

When a print request is made, operation control of the motors is prepared for the print processing, and the OD signal is monitored (S1). When the OD signal is detected, the cycle is checked to determine whether the request is for the primary or secondary print processing (S2). The first image requested for printing is preferably controlled and processed as a primary image.

In the primary processing, it is first determined whether the print request is a primary print request (S3). If the request is not a primary print request, the operation of timing control section is not permitted (S10), the information flow skips the following steps and is directed to the page completion block S21. When the print request is a primary print request, the page selection signal PSEL is set on "H" (S4), the operation of the timing control section is permitted (S5), a developing device is selected for developing the concerned color (S6), the image writing timing signal VSYNC and scanning direction timing signal LSYNC are output from the timing control 103, the page selection signal PSEL is output from the engine control CPU 104, the image data are output from the image processing controller 101, and the toner image is transferred onto the intermediate transfer drum to develop the image thereon (S7). When steps S4 through S7 are performed, it is next determined whether the image on the intermediate transfer drum is formed with all four colors (S8). If it is formed with four colors, the primary print request is cleared (S9) and the next primary print request may be allowed. The flow then goes out of the primary printing process and proceeds to the page completion block S21 where it is determined whether the entire page is printed. If the printing of the page is not finished, the flow returns to S1; if it is finished, the flow goes out of the printing sequence. If the image is not completed, i.e., if it is not formed with all four colors, the flow proceeds directly to the page completion block S21 without clearing the primary print request. From block S21 the flow is returned into the primary print sequence which is repeated until the formation of the image is completed.

In the secondary processing, it is first determined whether the received print request is a secondary print request (S11). If it is not a secondary print request, the timing control is not permitted (S20) and the flow skips to page completion block S21. If the received print request is a secondary print request, the page selection signal PSEL is set to "L" (S12), the mode is checked (S13), and if it is a copy mode, the flow skips the rotation delay check (S14). If the mode is a delay mode, the number of delay rotation is checked next (S14). When the number of delay rotations coincides with the predetermined number, the operation of the timing control section is permitted (S15), a developing device is selected for developing the concerned color (S16), the image writing timing signal VSYNC and scanning direction timing signal LSYNC are output from the timing control section 103, the page selection signal PSEL is output from the engine control CPU 104, the image data are output from the image processing controller 101, and the image is transferred onto the intermediate transfer drum to develop the image thereon (S17). Similarly to the primary processing, it is then determined whether the image is formed with all four colors (S18), and if it is formed with four colors, the secondary print request is cleared (S19) and the flow proceeds to block S21. If it is not formed with all four colors, the flow goes directly to the page completion block S21. When the printing of the page is not finished, the flow returns to S1. If it is finished, the flow goes out of the printing sequence.

There is a plurality of benefits realized with the described above configuration of the color image forming apparatus. For example, a high quality color image processing is made possible with high throughput regardless of whether the same image or different images are replicated for a plurality of different mediums. A color image processing is made possible by the present invention in which the synchronization of timing is easily accomplished and the proper image formation is performed when an external option is installed. Another advantage of the provided apparatus is that a color image processing is made possible without causing the operator to experience unwanted delays, when a scanner is installed as an external unit, and the apparatus of the present invention is used as a copying machine.

Heretofore, another embodiment of the present invention is explained, in which a switchover is provided between a first selection mechanism and a second selection mechanism, corresponding to the copy mode or any other operational mode respectively. This embodiment is preferably utilized when a plurality of the same images are printed or when the provided color image forming apparatus is used as a copying machine by installing a scanner as an external unit. The color image forming apparatus of the present embodiment may be configured so that the number of delay rotations of the intermediate transfer drum is arbitrarily set, when the second selection mechanism is selected. Additionally, the provided apparatus may also be configured so that the first selection mechanism, which consecutively forms the images developed by the same developing means when images for three or more recording mediums are formed on the intermediate transfer drum, is automatically selected.

Figure 6:
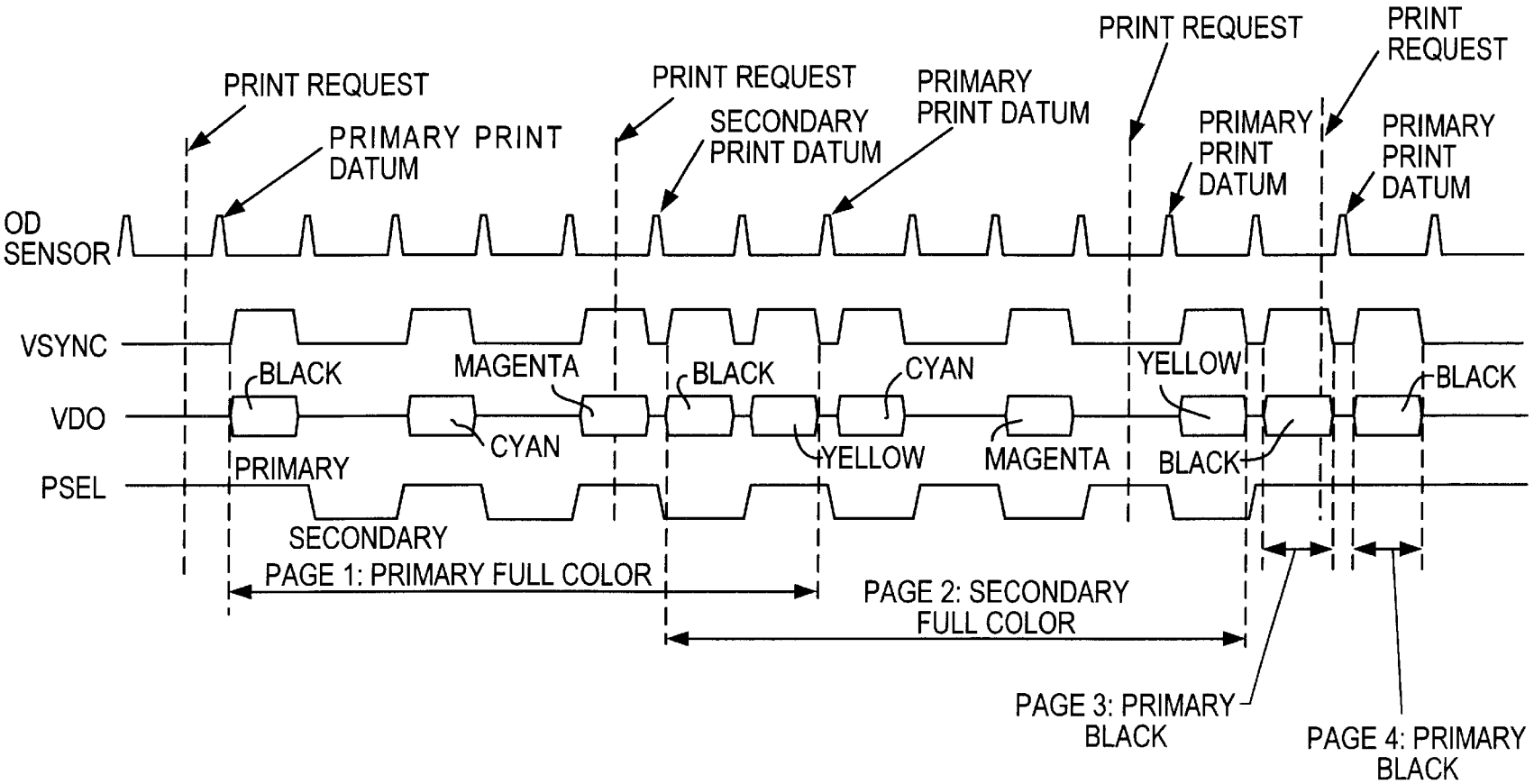
FIG. 6 is a diagram showing the basic timing and operational sequence of the apparatus when printing a plurality of pages in accordance with another embodiment of the present invention.

FIG. 6 is a diagram showing the basic timing and operational sequence of the apparatus when the printing of a plurality of pages is accomplished in accordance with another embodiment of the present invention. Both the process of full-color printing and the process of black monochrome printing will be explained by the diagram. When a full-color print request is made from the image processing controller 101 through the serial communication line, the first full-color image is formed on the primary area on the intermediate transfer drum in a manner described above with respect to the first embodiment. There is no predetermined position for the primary and secondary area on the intermediate transfer drum, the area on the intermediate transfer drum where the first image of the continuous image sequence is formed is the primary area.

As shown in FIG. 6, the secondary print start datum is reached after two delay rotations of the intermediate transfer drum. When a next print request is received through the serial communication line by the time when this secondary print start datum is reached, the image is formed on the secondary image area. The number of delay rotations is not fixed, and 1–3 delay rotation(s) are permissible.

When a subsequent print request is received through the serial communication line by the time when the next primary print start datum is reached, the image is formed on the primary area. In this process shown in FIG. 6, there is no print request at the time when the next primary print start datum is reached, therefore there is no image formation on the primary area.

When a next subsequent print request is received through the serial communication line by the time when the next print start datum is reached after the completion of the secondary image, initialization is done and the image is then formed on the primary area. As shown in FIG. 6, black monochrome print is requested and the image is formed in black on the primary side of the intermediate transfer drum after the initialization.

Figure 7:
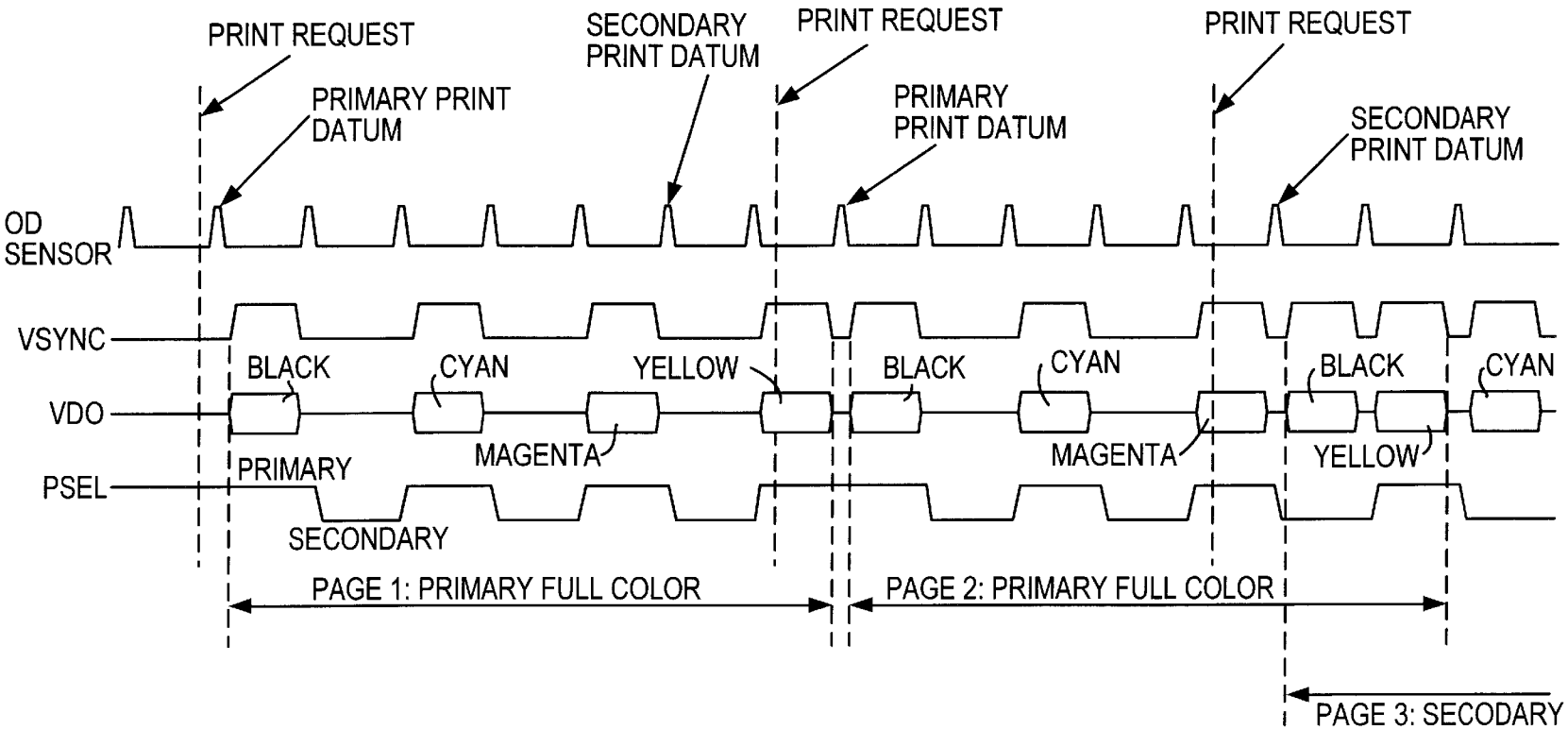
FIG. 7 is a diagram showing the timing and operational sequence of the apparatus when the printing of a plurality of pages is accomplished with a delay of print request, in accordance with another embodiment of the present invention.

FIG. 7 is a diagram explaining the print timing and operational sequence of printing a plurality of pages according to another embodiment of the present invention when the print request is delayed. When a full-color print request from the image processing controller 101 is received through the serial communication line, the first color image is formed on the primary area in the manner described above.

When a next print request is received through the serial communication line by the time when the secondary print start datum is reached after two delay rotations of the intermediate transfer drum, an image is formed on the secondary area. However, in the sequence shown in FIG. 7, there is no such print request by the time the secondary print start datum is reached. Therefore, the image formation on the secondary side is not performed.

When a subsequent print request is received through the serial communication line by the time when the next print start datum is reached after the completion of the primary formation, the image is formed on the primary area after initialization.

When a next subsequent print request is received through the serial communication line by the time when the next secondary print start datum is reached after two delay rotations of the intermediate transfer drum, the image is formed on the secondary area.

Figure 8:
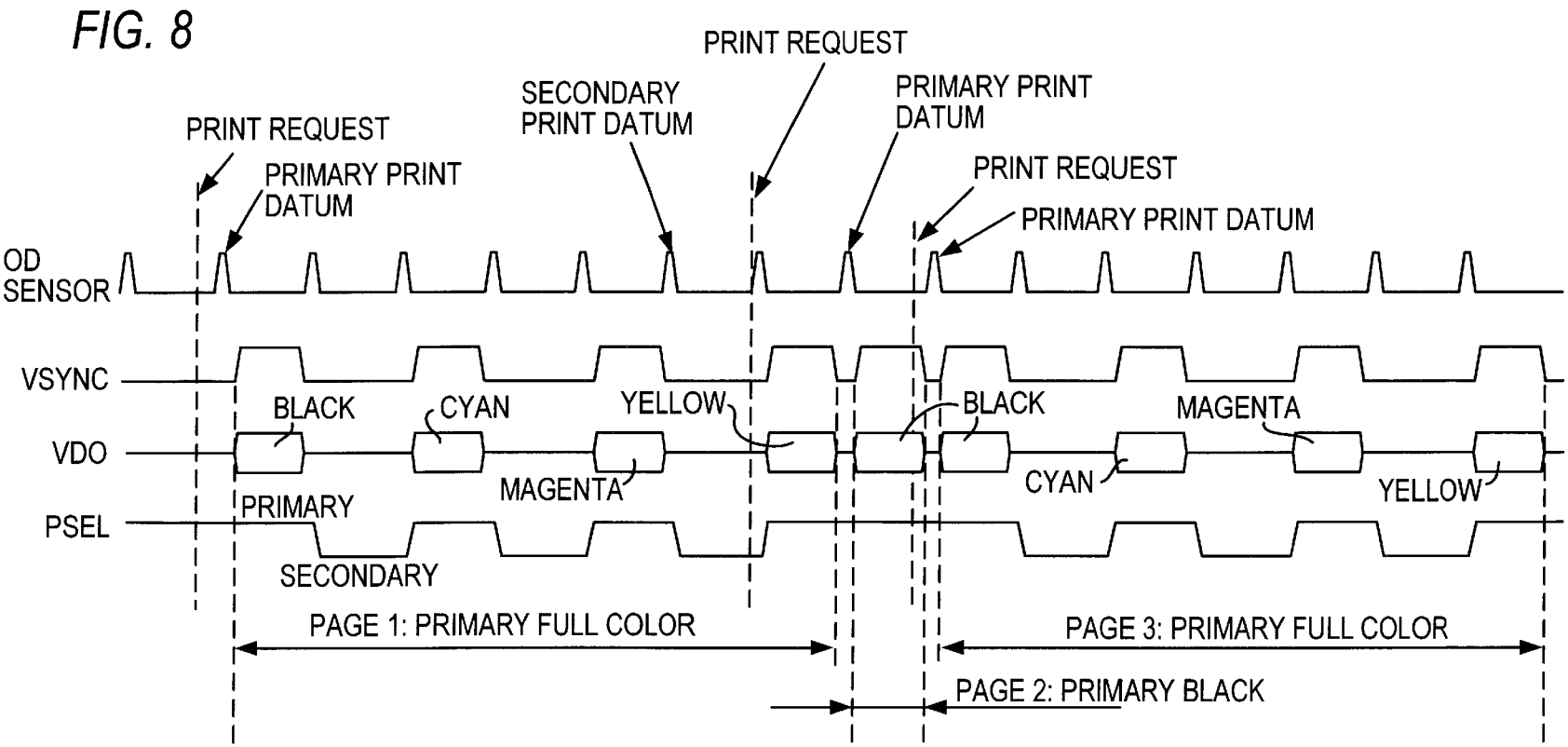
FIG. 8 is a diagram showing the timing and operational sequence of the apparatus when the printing of a plurality of pages of mixed monochrome and full-color images is accomplished in accordance with another embodiment of the present invention.

FIG. 8 is a diagram showing the timing and operational sequence of the apparatus when printing of a plurality of pages of mixed monochrome and full-color images is accomplished in accordance with another embodiment of the present invention.

When a full-color print request is made from the image processing controller 101 through the serial communication line, the first full-color image is formed on the primary area in the manner described above.

If a next print request is received through the serial communication line by the time when the secondary print start datum is reached after two delay rotations of the intermediate transfer drum, an image is formed on the secondary area. However, similarly to the embodiment shown in FIG. 7, there is no such printing request. Thus, the image formation on the secondary area is not performed.

When a subsequent print request is received through the serial communication line by the time when the next print start datum is reached after the completion of the prior primary image formation, the image is formed on the primary area after initialization. In the embodiment shown in FIG. 8, a black monochrome printing is requested, so the image is formed in black after initialization.

Although it is not shown in FIGS. 6–8, when the monochrome printing other than in black monochrome (for example, magenta) is carried out, the operation is controlled so that the printing is performed in four rotations, similarly to the full-color printing. Thus, printing of a plurality of pages in non-black monochrome is accomplished within the same cycle as the full-color printing. It is possible to change the printing cycle of the apparatus (for example, through the serial communication line) such that printing of any non-black monochrome, for example, magenta, is performed in one rotation, as described above for the black printing. In the case of black monochrome printing in which the image is formed in one rotation, the secondary processing is unnecessary, for print control is possible in the primary processing.

Figure 9:
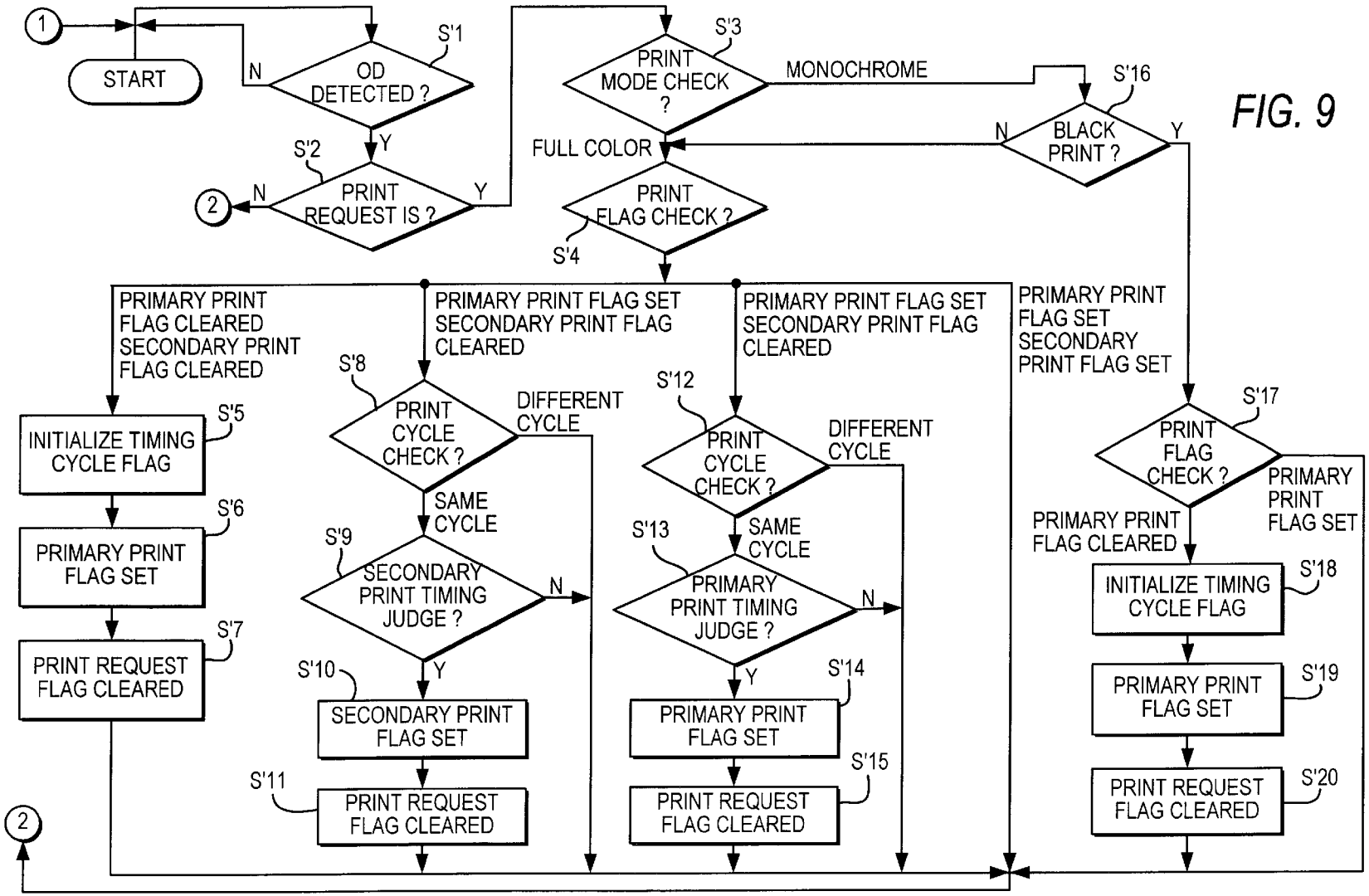
FIG. 9 is a flowchart showing the logical flow of information during the printing sequence of the apparatus in accordance with the second embodiment of the present invention.

FIG. 9 is a flowchart explaining the print sequence of the above described alternative embodiment of the present invention.

When a print request is made, operation control of the motors is prepared for the print processing, and the OD signal is monitored (S'1). When the OD signal is detected, it is determined whether printing of a plurality of pages is possible, and then the print control is carried out. The performance of the printing of a plurality of pages is carried out as follows.

First, it is determined whether there is a printing request (S'2). If printing is requested, print mode is checked (S'3). At the print mode check block it is determined whether the print request is for a full-color printing (S'3) or a monochrome printing other than black (S'16). A present printing state is then determined based on a provided flag (S'4) or (S'17).

If both primary and secondary print flags are cleared, timing and cycle flag are initialized (S'5), the primary print flag is set (S'6), the print request flag is cleared (S'7), and the print control is carried out.

Figure 10:
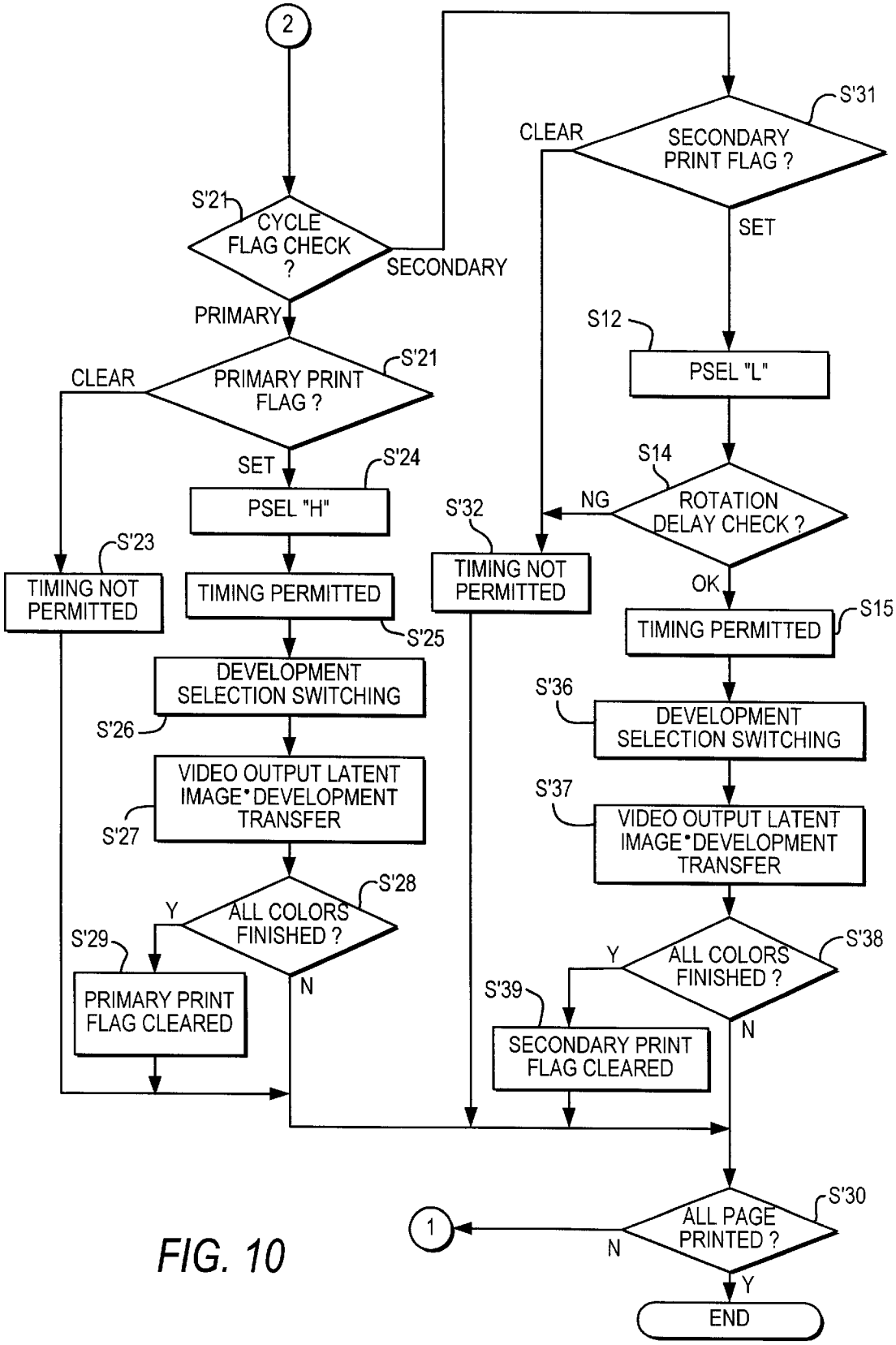
FIG. 10 is a continuation of the flowchart of FIG. 9 showing the logical flow of information during the printing sequence of the apparatus in accordance the second embodiment of the present invention.

If both primary and secondary print flags are set printing of a plurality of pages is not possible and the information flow skips to the starting point of the flowchart shown in FIG. 10.

If the primary print flag is set and the secondary print flag is cleared, the print cycle is compared with that of the page currently in printing (S'8). If the cycles are different from each other, the information flow skips to the starting point of the flowchart shown in FIG. 10. If the cycles are the same, it is next determined whether the secondary print start datum will be reached in this printing cycle (S'9). If it will not, the information flow skips to the starting point of the flowchart shown in FIG. 10. If there is the print start datum of the secondary image formation, the secondary print flag is set (S'10), the print request flag is cleared (S'11), and print control is carried out.

If the primary print flag is cleared and the secondary print flag is set, the print cycle is compared with that of the page in printing (S'12). If the cycles are different from each other, the information flow skips to the starting point of the flowchart shown in FIG. 10. If they are the same, it is next determined whether the cycle is within the print start datum of the primary image formation (S'13). If it is not, the information flow skips to the starting point of the flowchart shown in FIG. 10. If it is within the print start datum of the primary image formation, the primary print flag is set (S'14), the print request flag is cleared (S'15), and print control is carried out.

If the print request is black monochrome ("Yes" line of S'16), the print state is determined by the flag (S'17). If the print flag is set on a primary printing, the flow skips, because the printing is not possible. If the primary print flag is cleared, the timing and cycle flags are initialized (S'18), the primary print flag is set (S'19), the print request is cleared (S'20), and print control is carried out.

FIG. 10 is a continuation of the flowchart of FIG. 9 showing the logical flow of information during the printing sequence of the apparatus in accordance the second embodiment of the present invention. In the print control, the cycle flag is checked (S'21) to determine whether it is the primary or secondary cycle.

The sequence of the primary processing is as follows. The primary print flag is checked (S'22), and if the flag is cleared, the operation of the timing control section is not permitted (S'23) and the information flow skips to the page completion block S'30.

If the flag is set, the page selection signal PSEL is set on Primary "H" (S'24), the timing control section is permitted to operate (S'25), a developing device for developing the concerned color is selected (S'26), image writing timing signal VSYNC and scanning direction timing signal LSYNC are output from the timing control section 103, the page selection signal PSEL is output from the engine control CPU 104, and the image data are output from the image processing controller 101. This data is then transferred onto the intermediate transfer drum to form the image thereon (S'27).

The processing of black monochrome is included in the primary printing processing wherein the sequence is the same as described above but the print cycle is different.

In the page completion block S'30 it is determined whether the entire page has printed or not. If it has not, the flow returns to (1), and if it has, the flow goes out of the print sequence.

The sequence of the secondary processing is as follows. The secondary print flag is checked (S'31), if the flag is cleared, the operation of the timing control section is not permitted (S'32) and the flow skips to the page completion block S'30.

If the flag is set, the page selection signal PSEL is set on Secondary "L" (S'33), and the number of delay rotation is checked (S'34). If the number does not correspond to the preset number, the flow skips to the page completion block S'30. If the number corresponds to the preset number, the timing control section is permitted to operate (S'35), a developing device for developing the concerned color is selected (S'36), image writing timing signal VSYNC and scanning direction timing signal LSYNC are output from the timing control section 103, the page selection signal PSEL is output from the engine control CPU 104, and the image data is output from the image processing controller 101. This data is transferred onto the intermediate transfer drum to form the image thereon (S'37).

In the page completion block S'30 it is determined whether the entire page has printed or not. If it has not, the flow returns to (1), and if it has, the flow goes out of the print sequence.

As mentioned above, the present invention allows the images to be formed on the intermediate transfer drum consecutively when the toner images for two recording mediums of papers are of a specific monochrome. Images are formed on the intermediate transfer drum with a timing difference of a predetermined number of rotations of the intermediate drum, when the toner images for two recording mediums comprise a polychrome or a monochrome, other than the specific monochrome.

By using the provided color image forming apparatus it is possible to accomplish printing without outrunning the preceding page even when mixed monochrome and full-color printing is carried out. Thus, a color image forming apparatus with high throughput is provided. Although in the shown and described embodiments the circumference of the intermediate transfer drum is of such length that images for two recording sheets of A4-size may be transferred and formed thereon in landscape configurations, the intermediate drum may be formed to fit three or more sheets of the same or any other size. Further, although in the embodiments described above, the black monochrome is selected as a specific monochrome, it is possible to configure the disclosed apparatus so that the user can select arbitrarily the specific monochrome other than black, for example, yellow, cyan, or magenta.

It is also possible to incorporate the steps of the first embodiment into the second embodiment. As explained heretofore, the second embodiment of the present invention provides several advantages. First, a color image forming apparatus with high throughput can be realized even in the case where the print control takes into consideration the image processing time and mixed monochrome-and-full-color printing. Second, a print control without page outrunning is realized even where the print control takes into consideration the image processing time and mixed specific-monochrome-and-full-color printing. Also, images of specific monochrome can be printed at high speed, and images of monochrome other than the specific monochrome can be formed with improved color development. It is also an advantage of the presently provided apparatus that the toner of the developing device is stirred well in the capacity of the agitation ability.

While particular embodiments of the present invention have been described, it will be apparent to those skilled in the art that changes and modifications may be made without departing from this invention in its broader aspect and, therefore, the appended claims are to encompass within their scope all such changes and modifications that fall within the true sprit and scope of this invention.

What is claimed is:

1. A color image forming apparatus for printing color images for a plurality of recording mediums comprising:

at least one photoreceptor on which toner images corresponding to said plurality of recording mediums are formed, and an intermediate transfer drum, said intermediate transfer drum having a length of circumference such that a plurality of color images for said plurality of recording mediums can be held on said intermediate transfer drum, wherein said toner images are consecutively transferred from said at least one photoreceptor onto said intermediate transfer drum and are superposed on said intermediate transfer drum to form said color images; wherein said superposed color images are transferred from said intermediate transfer drum onto one of said plurality of recording mediums; wherein said toner images are formed on said at least one photoreceptor consecutively if said color images comprise solely a specific monochrome color; and wherein said toner images are formed on said at least one photoreceptor with a timing delay of a predetermined number of rotations of said intermediate transfer drum if said color images comprise a polychrome of two or more colors.

2. A color image forming apparatus according to claim 1 wherein said toner images are formed on said at least one photoreceptor with a timing delay of a predetermined number of rotations of said intermediate transfer drum if said color images comprise a monochrome other than said specific monochrome.

3. A color image forming apparatus according to claim 1, wherein said superimposed color images for a plurality of recording mediums are formed within the same image forming cycle on said intermediate transfer drum.

4. A color image forming apparatus according to claim 1, further comprising monochrome selecting means, said selecting means selecting said specific monochrome.

5. A color image forming apparatus according to claim 1, wherein when said superimposed color images with different formation cycles are formed consecutively on said intermediate transfer drum, a succeeding superimposed color image to be formed on said intermediate transfer drum is formed in an area where a preceding superimposed color image was formed.

6. A method of forming color images using a color image forming apparatus said apparatus having an intermediate transfer drum with a length of circumference such that a plurality of color images for a plurality of recording mediums can be held on said intermediate transfer drum, said method comprising the steps of:

selecting consecutive formation of images for said plurality of recording mediums on said intermediate transfer drum selecting delayed formation of said images for said plurality of recording mediums on said intermediate transfer drum, wherein said formation of said images is selected such that there is a time delay between formation of two consecutive images, and switching between said step of selecting said consecutive formation of said images and said step of selecting said delayed formation of said images.

7. A method of forming color images according to claim 6, wherein said step of switching between said step of selecting said consecutive formation of said images and said step of selecting said delayed formation of said images is done according to the operational mode of said apparatus.

8. A method of forming color images according to claim 6, wherein said time delay between said formation of said two consecutive images is set beforehand and is equal to a predetermined number of rotations of said intermediate transfer drum.

9. A method of forming color images according to claim 6, wherein images for three or more of said recording mediums are held on said intermediate transfer drum.

10. A color image forming apparatus for printing color images for a plurality of recording mediums comprising:

at least one photoreceptor on which toner images corresponding to said plurality of recording mediums are formed;

an intermediate transfer drum, said intermediate transfer drum having a length of circumference such that a plurality of color images for said plurality of recording mediums can be held on said intermediate transfer drum; and plural image formation control means, said plural image formation control means determining whether said formation of said toner images for said plurality of recording mediums is possible;

wherein said toner images are consecutively transferred from said at least one photoreceptor onto said intermediate transfer drum and are superposed on said intermediate transfer drum to form said color images; wherein said superposed color images are transferred from said intermediate transfer drum onto one of said plurality of recording mediums; wherein said toner images are formed on said at least one photoreceptor consecutively if said color images comprise solely a specific monochrome color; wherein said toner images are formed on said at least one photoreceptor with a timing delay of a predetermined number of rotations of said intermediate transfer drum if said color images comprise a polychrome of two or more colors; wherein a first of said superimposed color images for said plurality of recording mediums are formed on said intermediate transfer drum if said plural image formation control means determine that said formation of said superimposed color images is possible, and wherein a succeeding superimposed color image is formed on said intermediate transfer drum after said first superimposed color image is formed thereon if said plural image formation control means determine that the formation of said superimposed color images for a plurality of recording images is not possible, said succeeding superimposed color image being formed in an area of said intermediate transfer drum where said succeeding superimposed color image is possible to be formed.

11. A color image forming apparatus according to claim 10, wherein said plural image formation control means further comprises a start datum control means, said start datum control means determining an image formation start datum of each of said superimposed color images for said plurality of recording mediums, an image forming state control means, said image forming state control means determining the state of toner images formed on said intermediate transfer drum, and an image formation condition control means for determining sufficiency of the condition for a new superimposed color image formation; and wherein said formation of superimposed color images for said plurality of recording mediums on said intermediate transfer drum is determined to be possible if said image forming state control means determine that formation of a preceding superimposed color image is completed on said intermediate transfer drum, if said image formation condition control means determine that said image formation condition of said new superimposed color image is sufficient, and said image formation start datum is detected by said start datum control means.

12. A color image forming apparatus according to claim 11, wherein when said superimposed color images with different formation cycles are formed consecutively on said intermediate transfer drum, a succeeding superimposed color image to be formed on said intermediate transfer drum is formed in an area where a preceding superimposed color image was formed.

13. A color image forming apparatus according to claim 10, wherein when said superimposed color images with different formation cycles are formed consecutively on said intermediate transfer drum, a succeeding superimposed color image to be formed on said intermediate transfer drum is formed in an area where said preceding superimposed color image was formed.

14. A color image forming apparatus for printing color images for a plurality of recording mediums comprising:

at least one photoreceptor on which toner images corresponding to said plurality of recording mediums are formed;

an intermediate transfer drum, said intermediate transfer drum having a length of circumference such that a plurality of color images for said plurality of recording mediums can be held on said intermediate transfer drum; and plural image formation control means;

said plural image formation control means further comprising a start datum control means, said start datum control means determining an image formation start datum of each of said superimposed color images for said plurality of recording mediums, an image forming state control means, said image forming state control means determining the state of toner images formed on said intermediate transfer drum, and an image formation condition control means for determining sufficiency of the condition for a new superimposed color image formation;

wherein said toner images are consecutively transferred from said at least one photoreceptor onto said intermediate transfer drum and are superposed on said intermediate transfer drum to form said color images; wherein said superposed color images are transferred from said intermediate transfer drum onto one of said plurality of recording mediums; wherein said toner images are formed on said at least one photoreceptor consecutively if said color images comprise solely a specific monochrome color; wherein said toner images are formed on said at least one photoreceptor with a timing delay of a predetermined number of rotations of said intermediate transfer drum if said color images comprise a polychrome of two or more colors; and wherein said formation of superimposed color images for said plurality of recording mediums on said intermediate transfer drum is determined to be possible if said image forming state control means determine that formation of a preceding superimposed color image is completed on said intermediate transfer drum, if said image formation condition control means determine that said image formation condition of said new superimposed color image is sufficient, and said image formation start datum is detected by said start datum control means.

* * * * *